US005697798A

United States Patent [19]

Marechal

[11] Patent Number: 5,697,798

[45] Date of Patent: Dec. 16, 1997

[54] SOCKET FOR ELECTRICAL CONNECTION HAVING PROTECTED CONTACTS

[75] Inventor: Gilles Marechal, Paris, France

[73] Assignee: Societe d'Exploitation des Procedes Marechal (SEPM), Saint-Maurice Cedex, France

[21] Appl. No.: 565,097

[22] Filed: Nov. 30, 1995

[30] Foreign Application Priority Data

Dec. 2, 1994 [FR] France ..... 94 14514

[51] Int. Cl.[6] ..... H01R 13/44

[52] U.S. Cl. ..... 439/139

[58] Field of Search ..... 439/139, 136, 439/137, 333

[56] References Cited

U.S. PATENT DOCUMENTS 4,395,082 7/1983 Rumble ..... 439/139
5,234,350 8/1993 Marechal et al. .

FOREIGN PATENT DOCUMENTS 0528735 2/1993 European Pat. Off. .
2680607 2/1993 France .
2680608 2/1993 France .
0714802 9/1952 United Kingdom .

OTHER PUBLICATIONS

French Search Report.

*Primary Examiner*—Khiem Nguyen
*Assistant Examiner*—Eugene G. Byrd
*Attorney, Agent, or Firm*—Greenblum & Bernstein P.L.C.

[57] ABSTRACT

A socket provided with a plurality of peripherally arranged contacts for electrically connecting with a plug. The socket has a centrally located housing containing a central contact. A security disc, made of an insulating material, is arranged to be rotated upon insertion of the plug into the socket. An obturator is proved within the socket to cover the central contact. A mechanism is provided to connect the security disc to the obturator which rotates the obturator from an initial position where the peripheral and central contacts are covered, to a final position where the peripheral and central contacts are uncovered.

18 Claims, 2 Drawing Sheets

FIG. 1
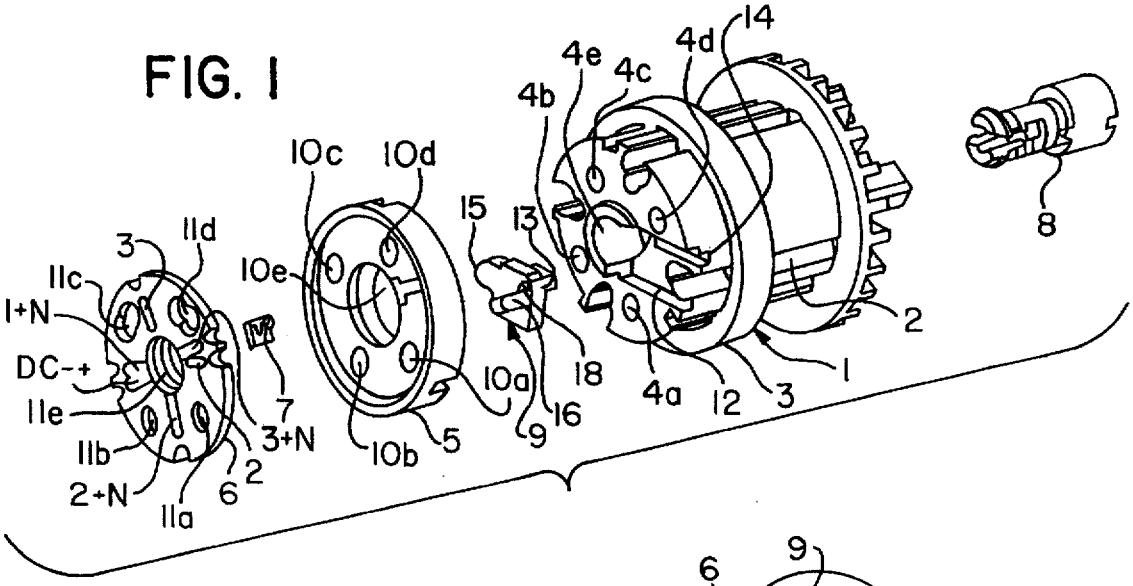
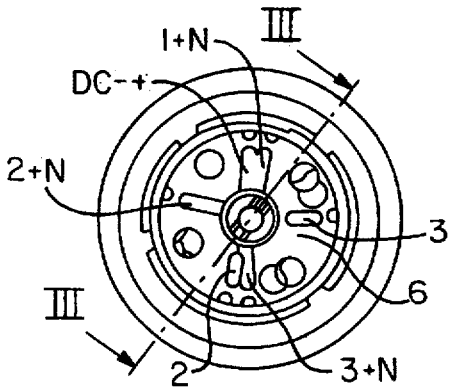
FIG. 2
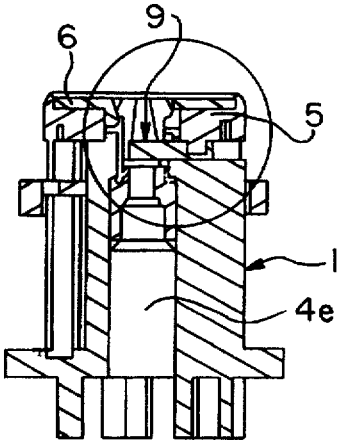
FIG. 3
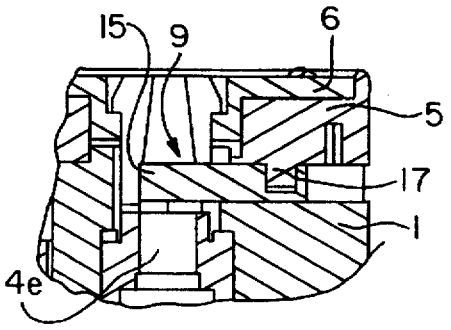
FIG. 4
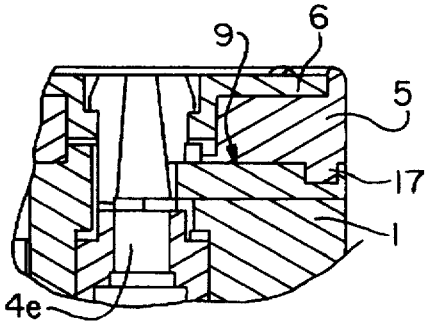
FIG. 5

SOCKET FOR ELECTRICAL CONNECTION HAVING PROTECTED CONTACTS

BACKGROUND OF THE INVENTION

1. Field of the Invention

The present invention relates to a socket for use in an electrical connector. More particularly, the present invention relates to a socket for use as a base of a plug and socket outlet or the connector of an extension cable or an appliance coupler.

2. Background Information

It is known to provide a socket outlet having a number of electrical contacts disposed circumferentially in a housing. Typically, another contact is disposed in the center of the housing. The sockets may include multiple contacts intended to be connected to a plug or a similar device provided with contacts in the form of pins. Generally, the center contact is an earth contact. (ground) or guard. This apparatus is particularly suited for socket outlets, but can be used in other type of sockets used in electrical connector systems, such as an appliance coupler or the connection of an extension cable which are adapted to accept a plug.

It is also known to provide at least one security disc composed of an insulating material mounted pivotally on the housing coaxially with the contacts. The disc may be furnished with openings which are traversed by the contacts of a plug inserted into the housing of the socket. The security disc is arranged in such a manner such that it can be moved upon insertion of the plug from an initial position, where the contacts are covered, to an final position, where the contacts are uncovered and can be electrically connected with the corresponding contacts of the plug.

Examples of the above are shown in French patents FR-2 680 607 and FR-2 680 608, the disclosures of which are hereby incorporated by reference in their entireties. The latter patent shows an arrangement including an additional complementary disc. The complementary disc is provided to enable several different positions for the contacts to be inserted into the socket, depending on the type of supply current.

Generally, the center contact is not protected as the other contacts by the disc or discs because it is very difficult to design a disengageable obstruction mechanism for the center contact which operates to cover the center contact as well as the circumpheral contacts during rotation of the disc because of the central position of both the contact and the obstruction mechanism.

Although each of the above-described sockets are often provided with a cover, it can be inconvenient in certain cases to leave the central housing open because it can be soiled and/or partially blocked. For example, if the socket is fitted into a particular premises during the course of building or renovation, there is a dangerous possibility that the earth contact may malfunction, whereas the rest of the apparatus may function properly.

SUMMARY OF THE INVENTION

Therefore, it is an object of the present invention to provide a socket of the type referred to above, but which is provided with an obturator for the central contact in a socket housing. The obturator is movably mounted in, or on, the housing for the electrical contacts and an engagement mechanism is provided for use with the obturator and a security disc. When the security disc is in an initial position, the central contact is blocked by the obturator, and upon rotation of the security disc in cooperation with engagement mechanism uncovers the central contact.

According to an embodiment of the present invention, a socket is provided for use in electrical connection with a plug. The socket includes a support including peripheral housings and a center housing, a plurality of peripheral contacts arranged circumferentially in the peripheral housings, a central contact disposed in the center housing of the support, at least one security disc of insulating material rotationally mounted coaxially with the plurality of contacts and including a plurality of openings corresponding to the peripheral contacts, an obturator movably mounted proximate to the center housing, and means for joining the at least one security disc to the obturator.

According to this embodiment, when the plurality of openings of the at least one security disc is traversed by contacts of a plug, upon rotation of the at least one security disc from a first position in which the peripheral housings are obscured, to a second position in which the peripheral housings are uncovered exposing the peripheral contacts, the obturator is moved by the joining means from the first position in which said center housing is obscured, to the second position in which the center housing is uncovered exposing the center contact.

Preferably, the obturator is mounted in the support and radially moveable and the joining means comprise an entraining lug positioned under the security disc and an oblique slot arranged in the obturator. Rotation of the security disc causes a radial translator movement of the obturator and allows said obturator to move from the first position covering the central housing to the second position where the central housing is uncovered.

Additionally, the oblique slot may have at one extremity a small prolongation in the direction of rotary movement, the small prolongation providing a the degree of play to the rotation of the security disc without affecting the translator movement of the obturator.

Further, the obturator may be movably mounted in a radial slot of the support which opens above or in the upper part of the center housing of the central contact.

According to another embodiment of the present invention, there is provided a socket as in the first embodiment which includes an obturator which is slidably mounted to permit free rotation about one end of the obturator proximate to the periphery of the support, and is provided at the other end with a slot, the slot cooperating with a lug arranged under the security disc. According to this embodiment, rotation of the security disc causes the obturator to slide from a position where the central housing is covered by the middle portion of the obturator, to an open position.

Preferably, the middle portion of the obturator slide has a projection.

BRIEF DESCRIPTION OF THE DRAWINGS

The present invention is further described in the detailed description which followed by reference to the noted drawings by way of non-limiting examples, in which like reference numerals represent similar parts throughout the views, and wherein:

FIG. 1 is an exploded perspective view of a socket outlet according to an embodiment of the invention;

FIG. 2 is a top view of the apparatus of FIG. 1, once assembled;

FIG. 3 is a section taken on lines III—III of FIG. 2, where the contacts are obstructed by the security disc and the obturator;

FIG. 4 is an enlarged view of the detail encircled in FIG. 3;

FIG. 5 corresponds to FIG. 4, but in an open position of the obturator; and

DETAILED DESCRIPTION OF THE PREFERRED EMBODIMENTS

Figure 6A:
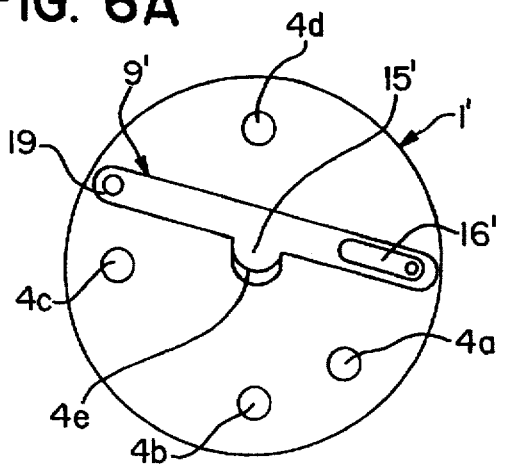
FIGS. 6A, 6B and 6C are top views of various central elements of a second embodiment of the invention in a closed position.

Referring to FIG. 1, the socket outlet includes an insulating support 1 provided notably with housings 2 for ejection springs arranged to act on an ejection and locking ring 3. The socket also includes a security disc 5 and a complementary coding disc 6 between which is provided a coding pawl 7. In addition, disposed between the support 1 and the security disc 5 is provided an obturator 9.

A number of housings 2 in the form of wells 4*a*–4*d* are arranged approximately circumferentially along with another centrally located housing 4*e*. contacts are provided in the circumferential housings 4*a*–4*d* and are, for example, the phase and neutral contacts. The central housing 4*e* is more particularly intended to receive the earth contact.

The security disc 5 and the complementary coding disc 6 are mounted on the support 1 by, for example, a ferrule 8. The security discs 5 and the complementary coding disc 6 are provided with ports 10*a*–10*d* and 11*a*–11*d*, respectively. The ports 10*a*–10*d* and 11*e*–11*d* correspond to the positions of the housings 4*a*–4*d* in the support 1 such that by rotation of the security disc 5 and the complementary coding disc 6, the ports 10*a*–10*d* and 11*a*–11*d* align with, and uncover, the housings 4*a*–4*d* in a opened position. The security disc 5 and the complementary coding disc 6 present respectively central openings 10*e* and 11*e* for the passage of the earth contact of the plug to the socket.

On the other hand, it will be understood that the security disc 5 and the complementary coding disc 6 serve to hide and protect the housings 4*a*–4*d*, and the contacts which are disposed therein in a closed position, as shown in FIG. 2.

The complementary coding disc 6 is not essential to the present invention and corresponds to an embodiment which allows the use of the same socket for a number of different types of current as described above and disclosed in French patent FR-2 680 608, previously cited herein and incorporated by reference in its entirety. This function is accomplished by a locking mechanism positioned in relation to the security disc 5 and the pawl 7 according to the various supply currents.

The obturator 9 is mounted so as to be radially slidable in a corresponding groove 12 of the support 1 which opens in or above the housing 4*e*. The obturator 9 has a projection 13 arranged to slide in a corresponding groove 14 of the support 1 in order to provide better guidance and/or support. The obturator 9 Is also provided with a rounded protuberance 15 and with an oblique slot or groove 16.

It will be well understood that by sliding the obturator 9 in the groove 12, the obturator 9 can rotate from a position in which the housing is fully uncovered to a position where the housing is obstructed. To perform this operation, the security disc 5 has a lug 17 (not shown in FIGS. 1 and 2) as shown in FIGS. 3–5. The lug 17 is intended to enter the slot 16 of the obturator 9. Thus, as the security disc 5 and the complementary coding disc 6 are turned, the combined effect of the lug 17 and security disc 5 and the oblique slot 16 of the obturator 9 corresponds effectively to a cam which transforms the rotary movement of the security disc 5 and the complementary coding disc 6 to a translator movement of the obturator 9.

In particular the slot 16 of the obturator 9 has at one of its extremities a prolongation 18 in the direction of rotary movement to provide a small amount of play in the rotation of the security disc 5. The obturator 9 may have another prolongation arranged symmetrically with the first prolongation 18 at its other extremity without effecting the translator movement of the obturator 9, and thus avoid any untimely movement of the obturator 9 because of small movements of the security disc 5 and the complementary coding disc 6.

Referring now to FIG. 3, and the enlarged detail shown in FIG. 4, a position in which the obturator 9 blocks the entry of housing 4*e* of the support 1 is shown. Another position is represented in FIG. 5, where the obturator 9 uncovers the housing 4*e*.

Thus, in one position, all housings 4*a*–4*e* can be masked or blocked by the security disc 5, the complementary coding disc 6 and by the obturator 9. After inserting and rotating the plug, all the contact housings 4*a*–4*e* are uncovered including that of the earth and a simple push of the plug allows the contacts of the plug and the socket to connect. The plug can be disconnected by rotation in the opposite which also serves to block the housings 4*a*–4*e* by inverse movement of the obturator 9.

FIGS. 6A, 6B, 6C, 7A, 7B and 7C show another embodiment of the present invention of which similar elements as those described above are referenced by the same reference numerals with a prime thereafter.

Figure 7A:
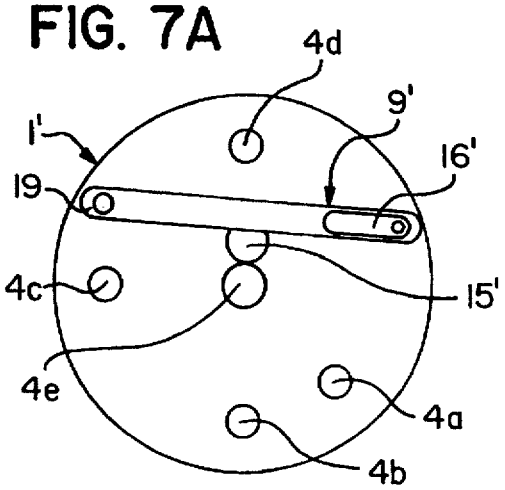
FIGS. 7A, 7B and 7C are top views of various central element of the second embodiment of the invention in an open position.
Figure 6B:
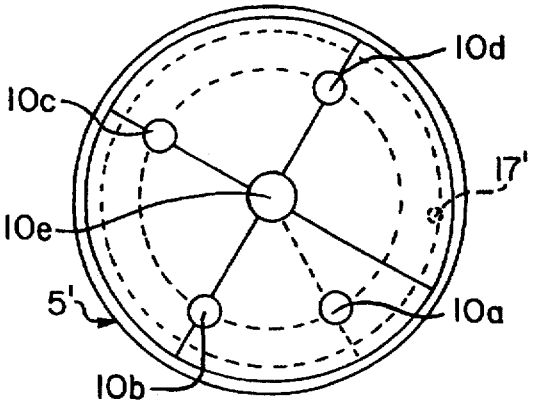
Figure 7B:
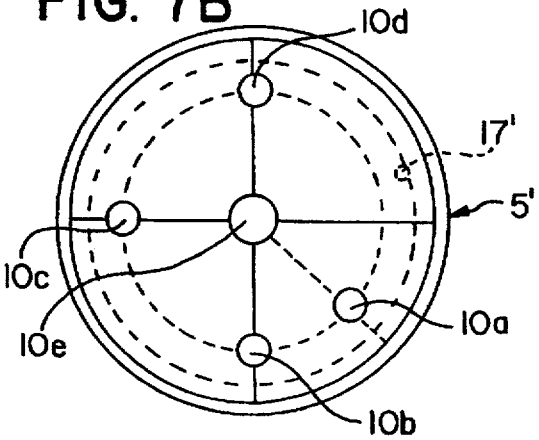
Figure 6C:
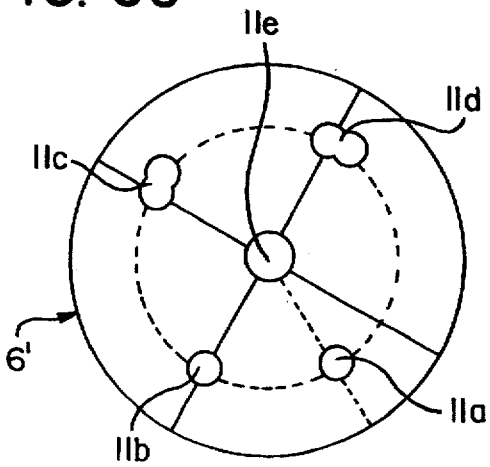
Figure 7C:
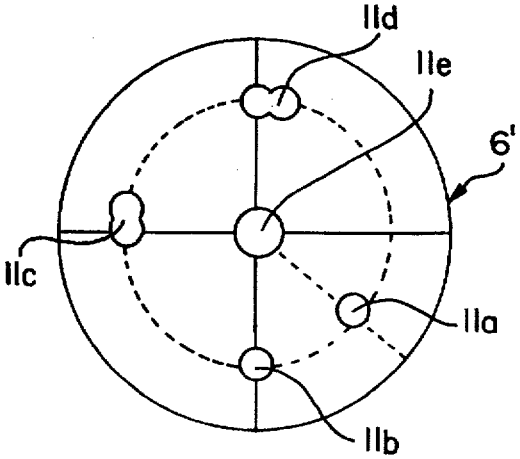

FIGS. 6A, 6B, 6C, 7A, 7B and 7C show a schematic representation of the support 1' and the security disc 5' and the complementary coding disc 6' in the positions where the contacts are masked (FIG. 6A), and the opposite position where the contacts are uncovered (FIG. 7A).

According to this embodiment of the invention, the obturator 9' is formed as an articulated slide free to rotate about one of its extremities 19, whereas its other extremity has an oblong slot or groove 16' in the axis of the slide. The groove 16' is intended to cooperate with a lug of disc 5', the position of which is shown by reference numeral 17'. However, it is to be understood that the oblong slot 16' could be provided at the turning extremity 19.

The middle portion of the obturator 9' has a protuberance or rounded bulge 15' arranged to obscure the central housing 4*e* of the support 1', as is shown in FIG. 6. Additionally, the openings 10*a*–10*e* and 11*a*–11*e* of the security disc 5' and the complementary coding disc 6', respectively, art not in alignment with the housings 4*a*–4*d* of the support 1'.

Rotation of the security disc 5' and the complementary coding disc 6' effects through the cooperation of the lug 17' of the disc 5' and the slot 16' of the obturator 9' movement from the position shown in FIG. 6A to that of the position shown in FIG. 7A, and vice versa. Thus, the openings 10*a*–10*d* and 11*a*–11*d* shown in FIG. 7C overly the housings 4*a*–4*e* of the support 1', exposing housing 4*a*–4*e*.

As stated above, the support 1 or 1' can not only be used in socket outlet, but also as a socket in a connector provided for connection either to an appliance inlet or a cable coupler.

While the invention has been described with reference to several exemplary embodiments, it is understood that the words with have been used herein are words of description and illustration, rather than words of limitation. Changes may be made, without departing from the scope and spirit of the invention in its aspects. The invention extends to all functionally equivalent structures, methods and uses, such as are within the scope of the appended claims.

This application is related to French Patent Application 9414514, filed Dec. 2, 1994, to which priority is claimed, and the entire disclosure of which is hereby incorporated by reference.

What is claimed:

1. A socket for use in electrical connection with a plug, said socket comprising:

a support including peripheral housings and a center housing;

a plurality of peripheral contacts arranged circumferentially in said peripheral housings;

a central contact disposed in said center housing of said support;

at least one security disc of insulating material rotationally mounted coaxially with said plurality of contacts, said at least one security disc including a plurality of openings corresponding to said peripheral contacts;

an obturator movably mounted proximate to said center housing; and joining means for joining said at least one security disc to said obturator;

wherein when said plurality of openings of said at least one security disc is traversed by contacts of a plug, upon rotation of said at least one security disc from a first position in which said peripheral housings are obscured, to a second position in which said peripheral housings are uncovered exposing said peripheral contacts, said obturator is moved by said joining means from said first position in which said center housing is obscured, to said second position in which said center housing is uncovered exposing said center contact.

2. A socket according to claim 1, wherein said obturator is mounted in said support and radially moveable and said joining means comprise an entraining lug positioned under said security disc and an oblique slot arranged in said obturator, wherein rotation of said security disc causes a radial translator movement of said obturator and allows said obturator to move from said first position covering said central housing to said second position where said central housing is uncovered.

3. A socket according to claim 2, wherein said oblique slot has at one extremity a small prolongation in the direction of rotary movement, said small prolongation providing a small degree of play to one rotation of said security disc without affecting the translator movement of said obturator.

4. A socket according to claim 2, wherein said obturator is movably mounted in a radial slot of said support which opens in the upper part of said center housing of said central contact.

5. A socket according to claim 2, wherein said obturator is movably mounted in a radial slot of said support which opens above the upper part of said center housing of said central contact.

6. A socket according to claim 3, wherein said obturator is movably mounted in a radial slot of said support which opens in the upper part of said center housing of said central contact.

7. A socket according to claim 3, wherein said obturator is movably mounted in a radial slot of said support which opens above the upper part of said center housing of said central contact.

8. A socket according to claim 1, wherein said obturator is slidably mounted to permit free rotation about one end of said obturator proximate to the periphery of said support, wherein said joining means comprises a lug arranged under said security disc and a slot provided at the other end of said obturator adapted to receive said lug, and wherein rotation of said security disc causes said obturator to slide from a position where said central housing is covered by the middle portion of said obturator, to an open position.

9. A socket according to claim 8, wherein said middle portion of said obturator slide has a projection.

10. A socket for use in electrical connection with a plug, said socket comprising:

a support including peripheral housings and a center housing;

a plurality of peripheral contacts arranged circumferentially in said peripheral housings;

a central contact disposed in said center housing of said support;

at least one security disc of insulating material rotationally mounted coaxially with said plurality of contacts, said at least one security disc including a plurality of openings corresponding to said peripheral contacts;

an obturator movably mounted proximate to said center housing; and a connector adapted to connect said at least one security disc to said obturator;

wherein when said plurality of openings of said at least one security disc is traversed by contacts of a plug, upon rotation of said at least one security disc from a first position in which said peripheral housings are obscured, to a second position in which said peripheral housings are uncovered exposing said peripheral contacts, said obturator is moved by said connector from said first position in which said center housing is obscured, to said second position in which said center housing is uncovered exposing said center contact.

11. A socket according to claim 10, wherein said obturator is mounted in said support and radially moveable, wherein said connector comprises an entraining lug positioned under said security disc and an oblique slot arranged in said obturator adapted to receive said entraining lug, and wherein rotation of said security disc causes a radial translator movement of said obturator and allows said obturator to move from said first position covering said central housing to said second position where said central housing is uncovered.

12. A socket according to claim 11, wherein said oblique slot has at one extremity a small prolongation in the direction of rotary movement, said small prolongation providing a small degree of play to the rotation of said security disc without affecting the translator movement of said obturator.

13. A socket according to claim 11, wherein said obturator is movably mounted in a radial slot of said support which opens in the upper part of said center housing of said central contact.

14. A socket according to claim 11, wherein said obturator is movably mounted in a radial slot of said support which opens above the upper part of said center housing of said central contact.

15. A socket according to claim 12, wherein said obturator is movably mounted in a radial slot of said support which opens in the upper part of said center housing of said central contact.

16. A socket according to claim 12, wherein said obturator is movably mounted in a radial slot of said support which opens above the upper part of said center housing of said central contact.

17. A socket according to claim 10, wherein said obturator is slidably mounted to permit free rotation about one end of said obturator proximate to the periphery of said support, wherein said connector comprises a lug arranged under said security disc and a slot provided at the other end of said obturator adapted to receive said lug, and wherein rotation of said security disc causes said obturator to slide from a position where said central housing is covered by the middle portion of said obturator, to an open position.

18. A socket according to claim 17, wherein said middle portion of said obturator slide has a projection.

* * * * *